US006790108B1

(12) United States Patent
Schiebout

(10) Patent No.: US 6,790,108 B1
(45) Date of Patent: Sep. 14, 2004

(54) BOAT PROPULSION SYSTEM

(76) Inventor: Dan Schiebout, 906 7th St. NW., Orange City, IA (US) 51041

( * ) Notice: Subject to any disclaimer, the term of this patent is extended or adjusted under 35 U.S.C. 154(b) by 0 days.

(21) Appl. No.: 10/365,004

(22) Filed: Feb. 12, 2003

(51) Int. Cl.[7] ..... B63H 25/42

(52) U.S. Cl. ..... 440/51; 440/71; 440/83; 440/111

(58) Field of Search ..... 440/75, 49, 51, 440/71, 83, 111

(56) References Cited

U.S. PATENT DOCUMENTS

| | | | | | |
|---|---|---|---|---|---|
| 1,730,844 | A | | 10/1929 | Dupuis | |
| 1,869,977 | A | * | 8/1932 | Modin | 440/71 |
| 2,956,533 | A | | 10/1960 | De Yo | |
| 3,136,288 | A | * | 6/1964 | Hardy | 440/63 |
| 3,195,496 | A | * | 7/1965 | Skuce, II | 114/271 |
| 3,339,514 | A | * | 9/1967 | Skuce, II | 114/290 |
| 3,698,497 | A | | 10/1972 | Bomardier | |
| 4,241,687 | A | | 12/1980 | DuBois et al. | |
| 4,337,053 | A | | 6/1982 | Stevens | |
| 4,553,945 | A | | 11/1985 | Foster | |
| 4,592,299 | A | | 6/1986 | Christiansen | |
| 4,726,799 | A | * | 2/1988 | Harada et al. | 440/76 |
| 4,850,938 | A | * | 7/1989 | Yamada | 474/28 |
| 4,854,903 | A | * | 8/1989 | Sirois | 440/83 |
| 4,911,663 | A | | 3/1990 | Meier | |
| 4,925,412 | A | | 5/1990 | Karls | |
| 4,954,108 | A | | 9/1990 | Govan | |
| 5,249,993 | A | | 10/1993 | Martin | |
| 6,276,230 | B1 | | 8/2001 | Crum et al. | |

* cited by examiner

*Primary Examiner*—Stephen Avila
(74) *Attorney, Agent, or Firm*—Leonard & Proehl, Prof. L.L.C.

(57) ABSTRACT

A boat propulsion system for propelling a boat through water with debris in the water and shallows. The boat propulsion system includes a motor assembly being designed for being positioned in a boat. A propeller member is operationally coupled to the motor assembly whereby the propeller member is rotated by the motor assembly. The propeller member is designed for being positioned under the boat whereby the propeller member is positioned in the water for rotating in the water to propel the boat through the water when the propeller member is rotated by the motor assembly. A direction assembly is designed for being coupled to the boat. The direction assembly is designed for being actuated by the user whereby the direction assembly is for controlling the direction of the boat when the propeller member is propelling the boat through the water.

17 Claims, 9 Drawing Sheets

BOAT PROPULSION SYSTEM

BACKGROUND OF THE INVENTION

1. Field of the Invention

The present invention relates to boat drag reduction systems and more particularly pertains to a new boat propulsion system for propelling a boat through water with debris in the water and shallows.

2. Description of the Prior Art

The use of boat drag reduction systems is known in the prior art. U.S. Pat. No. 4,592,299 describes a system for providing a rudder that produces less drag when the vessel is traveling through the water. Another type of boat drag reduction system is U.S. Pat. No. 4,925,412 having a weed deflector that deflects weeds away from the propeller of an outboard motor to prevent the weeds from fowling the propeller of the motor. U.S. Pat. No. 4,553,945 has a safety shroud that is positioned over a propulsion system for a boat to inhibit inadvertent access to the propeller and thereby inhibiting injury due to contact with propeller. U.S. Pat. No. 4,337,053 has a throttle control grip that is coupled to the marine propulsion unit and is sculpted to provide greater comfort to a user when the user is operating the marine propulsion unit. U.S. Pat. No. 3,698,497 has a variable speed transmission system coupled to a motor for a snowmobile to provide power to drive the endless track of the snowmobile. U.S. Pat. No. 1,730,844 has a detachable fin for boats to allow for transportation of the boat with out damaging the fin. U.S. Pat. No. 2,956,533 has a rudder attachment that is coupled to outboard motors to allow the user to steer the boat when the propeller is not rotating or is rotating at an extremely slow speed. U.S. Pat. No. 6,276,230 has a throttle control that is positioned at the end of handle bar to allow the user to control the operating speed of a motor when the hand of the user is positioned on the handle bar. U.S. Pat. No. 4,241,687 has a throttle control that is operationally coupled to an outboard motor that allows the user to control the speed of the outboard motor by twisting the throttle control. U.S. Pat. No. 5,249,993 has a boat propeller that is resistant to becoming fowled by weeds. U.S. Pat. No. 4,911,663 has a system for reducing weed migration between the gearcase and the propeller hub when a small hub propeller is used. U.S. Pat. No. 4,954,108 has a line cutter that is positioned adjacent a propeller of an outboard motor to cut fishing lines, weeds and such away from the propeller to inhibit the items from fowling the propeller.

While these devices fulfill their respective, particular objectives and requirements, the need remains for a system that has certain improved features that allows a boat to operate in the shallows of a body of water without being impeded by mud and objects positioned in the water.

SUMMARY OF THE INVENTION

The present invention meets the needs presented above by providing a deflector member that extends away from the sleeve member and deflects objects in the water away from the propeller as well as cutting into the mud to loosen the mud and allow the propeller member to rotate through the mud and continue propelling the boat through the water.

Still yet another object of the present invention is to provide a new boat propulsion system that provides a sleeve member positioned around the drive shaft 18 to protect the drive shaft 18 from being damaged by objects in water that might gouge the drive shaft 18 and cause the drive shaft 18 to become unbalanced.

Even still another object of the present invention is to provide a new boat propulsion system that provides a torque converter to allow power to be transferred to the propeller member to allow the propeller member to power through thicker substances and continue propelling the boat through the water.

To this end, the present invention generally comprises a motor assembly being designed for being positioned in a boat. A propeller member is operationally coupled to the motor assembly whereby the propeller member is rotated by the motor assembly. The propeller member is designed for being positioned under the boat whereby the propeller member is positioned in the water for rotating in the water to propel the boat through the water when the propeller member is rotated by the motor assembly. A direction assembly is designed for being coupled to the boat. The direction assembly is designed for being actuated by the user whereby the direction assembly is for controlling the direction of the boat when the propeller member is propelling the boat through the water.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
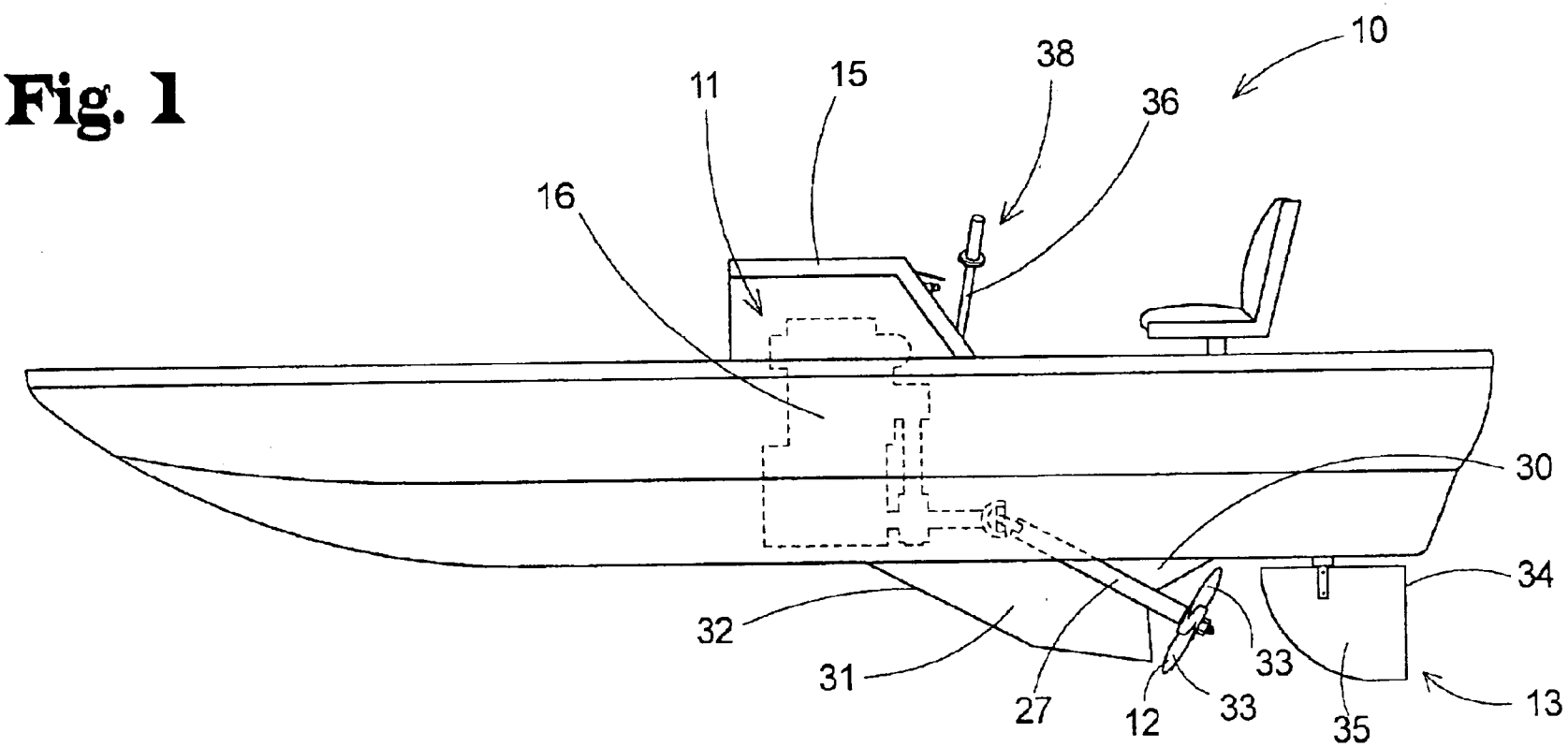
FIG. 1 is a side view of a new boat propulsion system according to the present invention.
Figure 2:
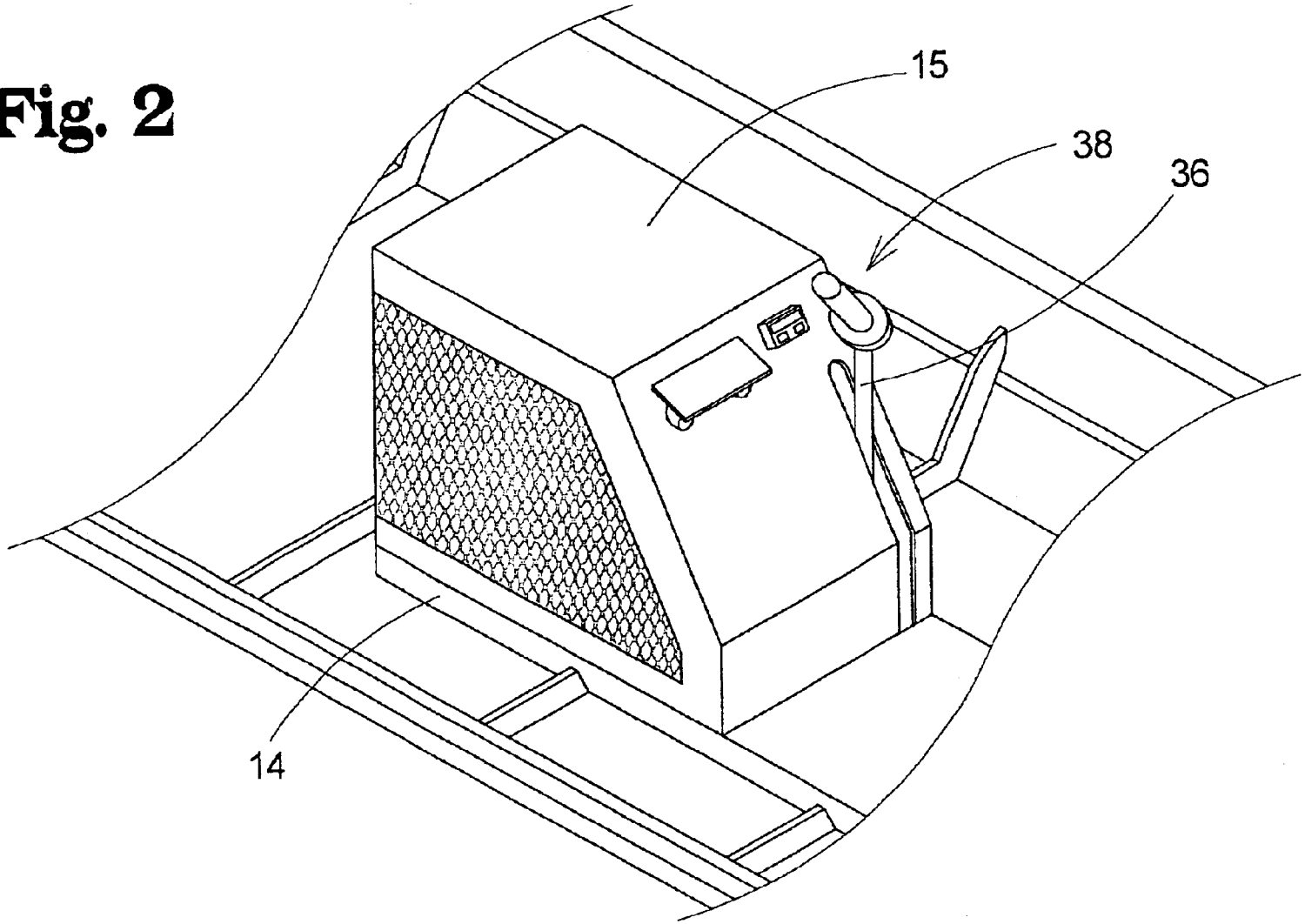
FIG. 2 is a perspective view of the shroud member and the control arm of the direction assembly of the present invention as seen by a user sitting in a seat of the boat.
Figure 3:
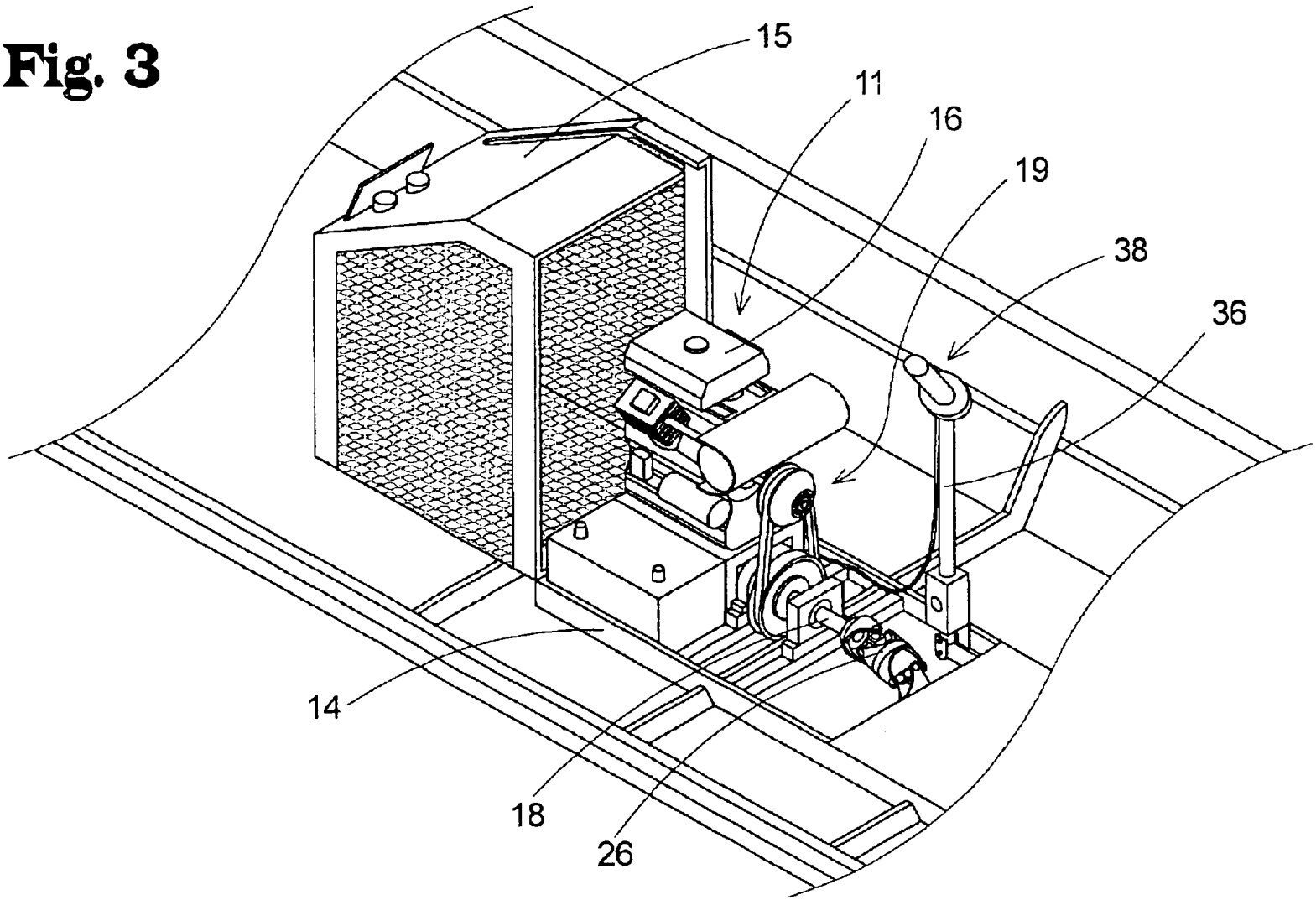
FIG. 3 is a perspective view of the motor assembly and control arm of the present invention.
Figure 4:
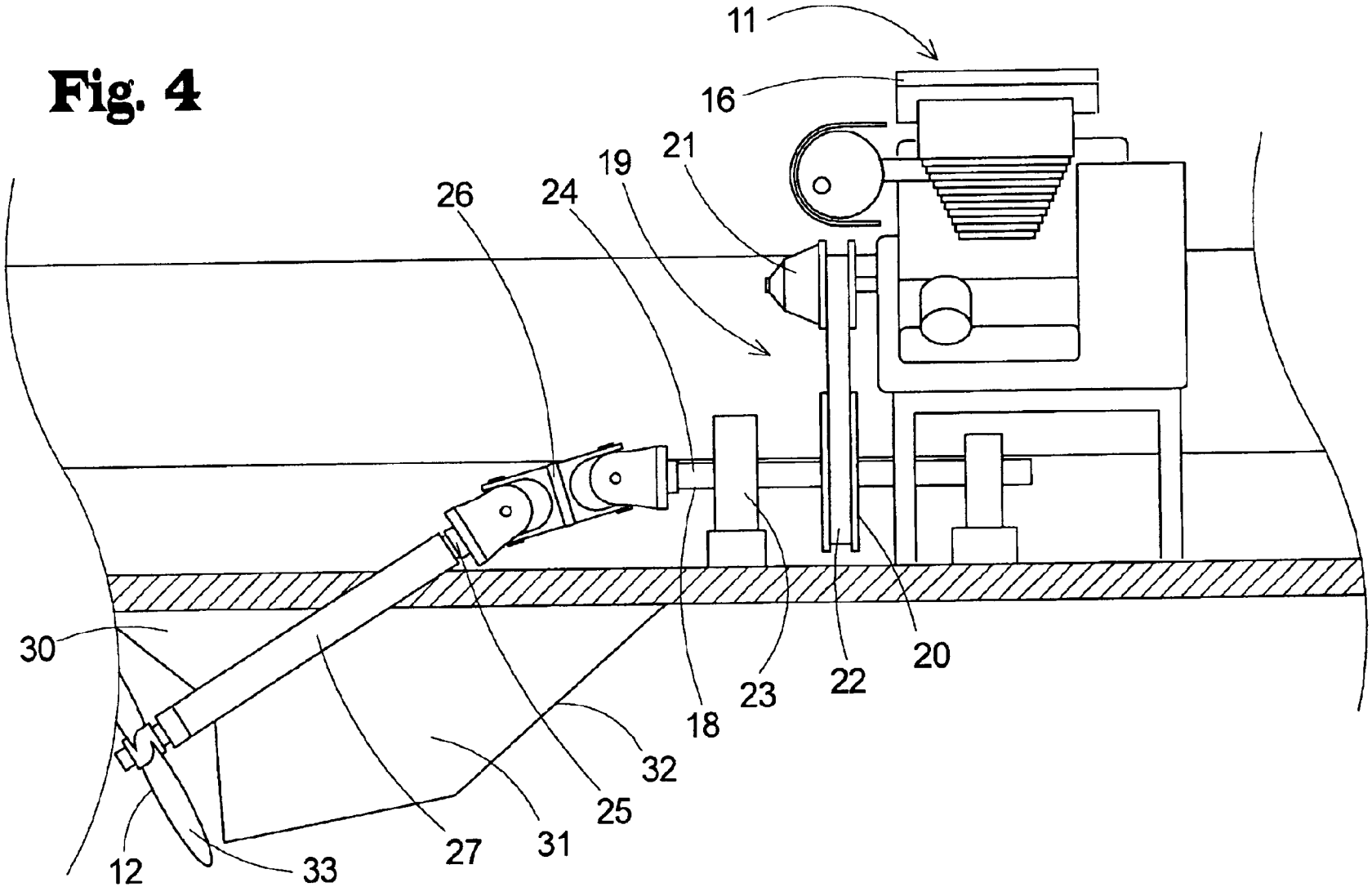
FIG. 4 is a side view of the motor assembly of the present invention.
Figure 5:
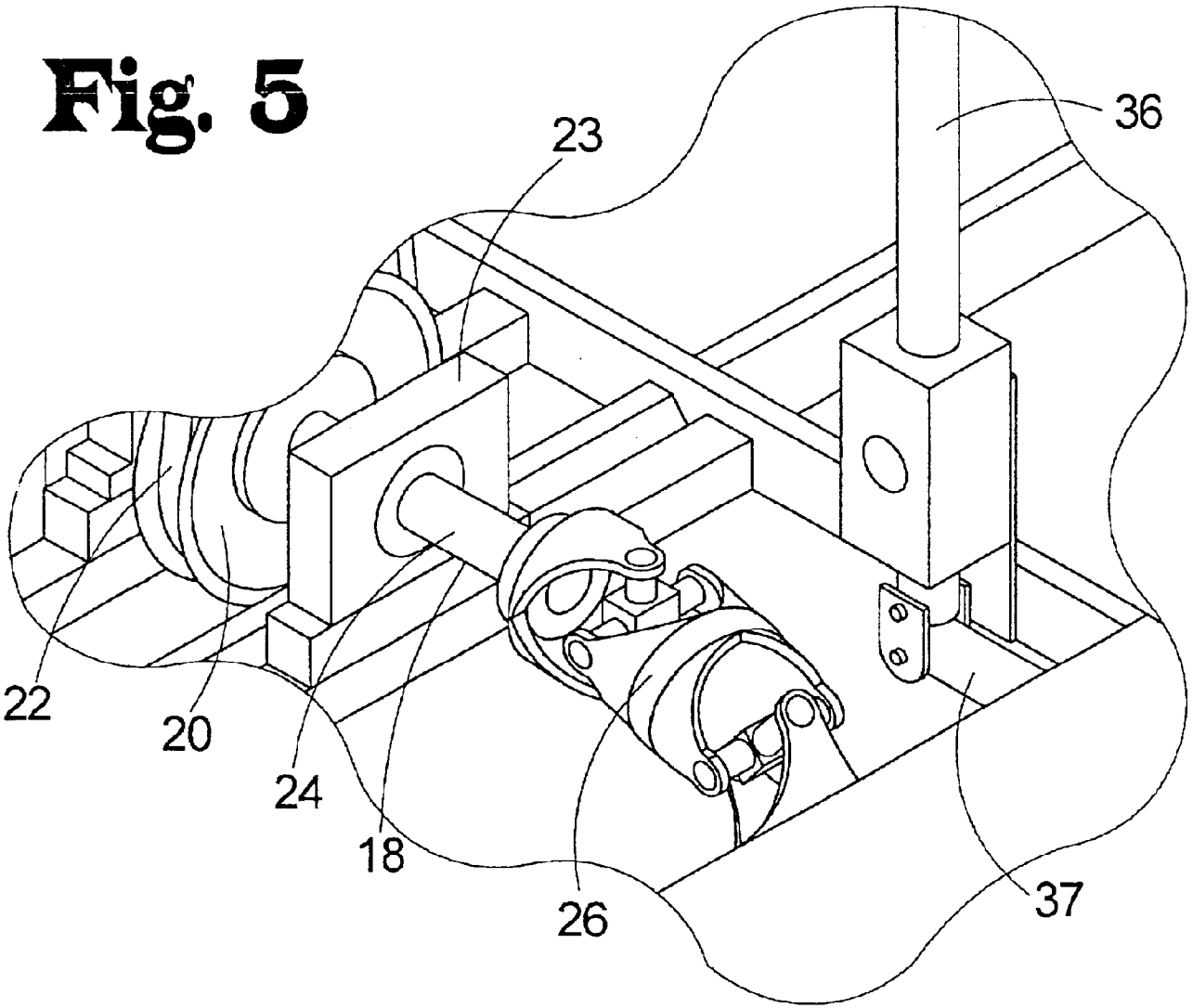
FIG. 5 is an enlarged side view of the drive shaft 18, knuckle and slip clutch assembly of the motor assembly of the present invention.
Figure 6:
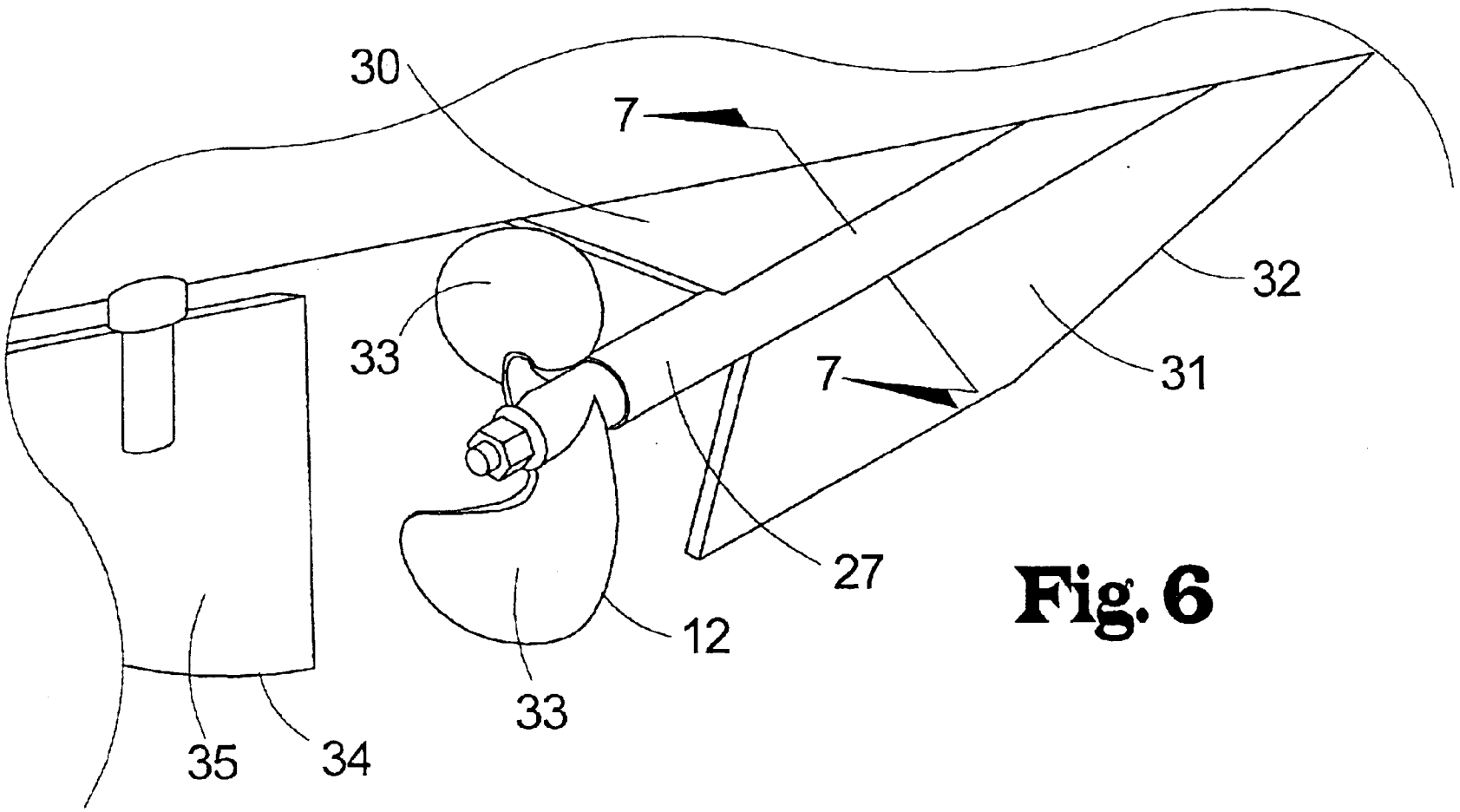
FIG. 6 is a perspective view of the propeller member, deflector member and sleeve member of the present invention.
Figure 7:
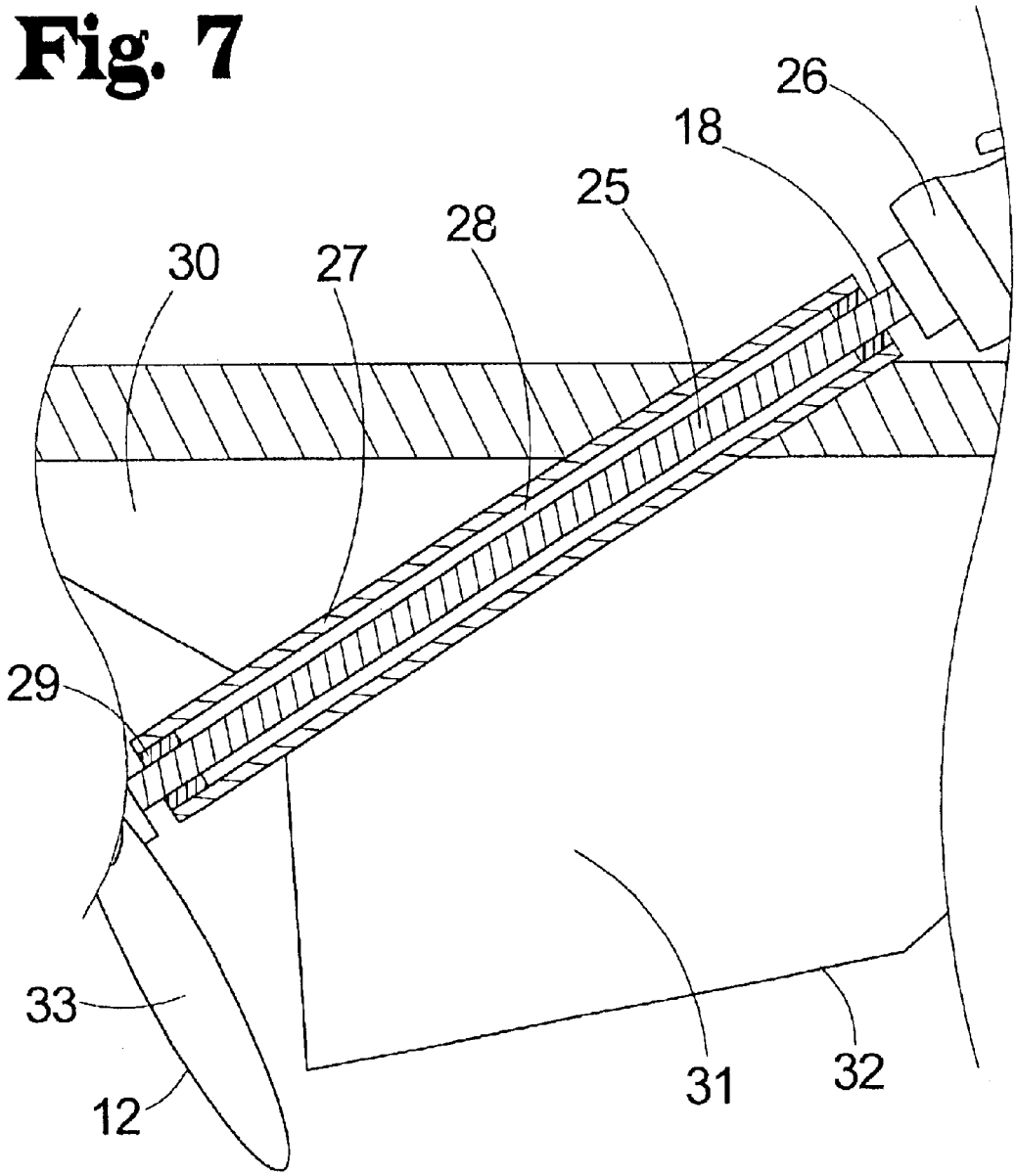
FIG. 7 is a schematic cross-sectional view of the sleeve member of the present invention taken along line 7—7 of FIG. 6.
Figure 8:
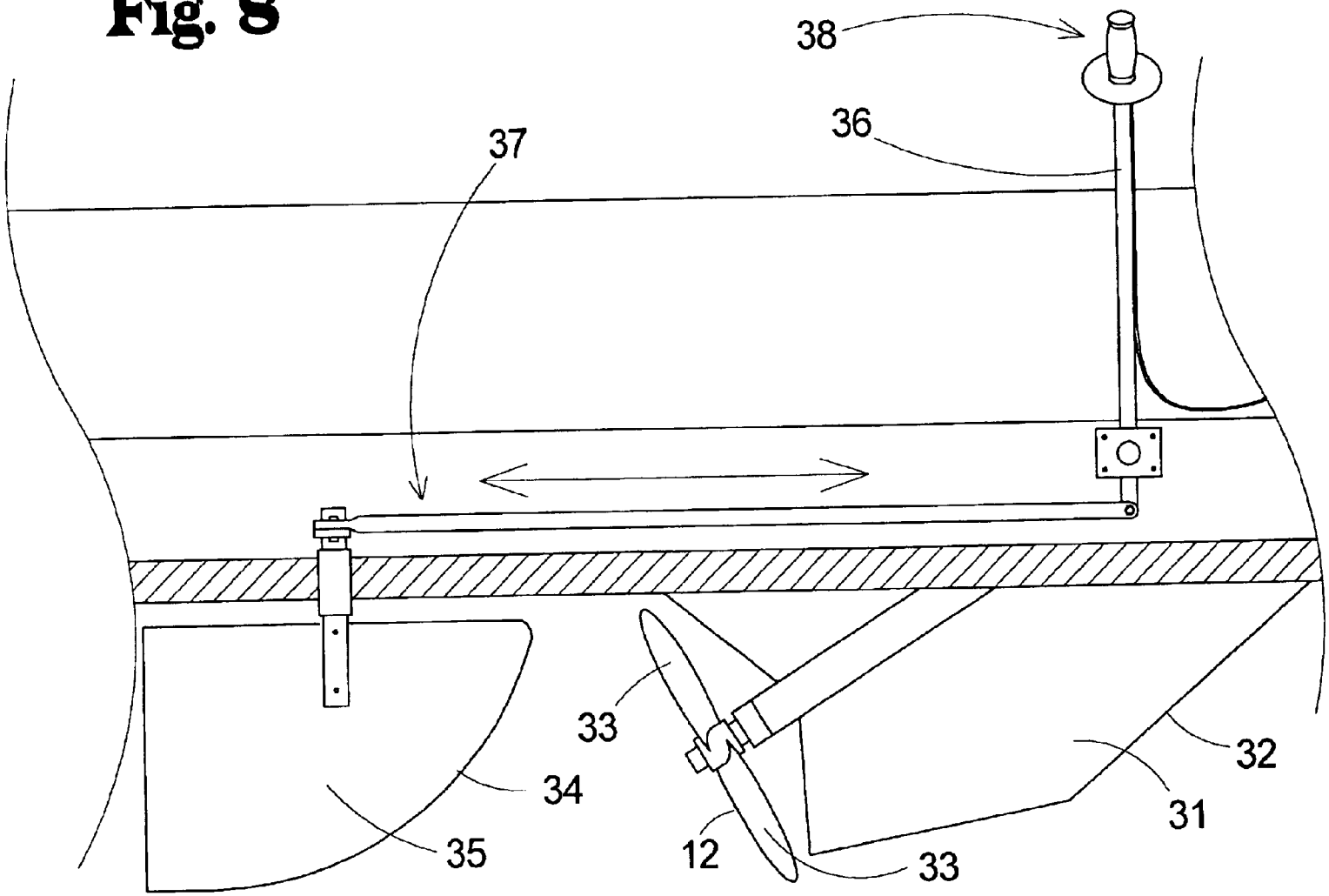
FIG. 8 is a side view of the direction assembly of the present invention.
Figure 9:
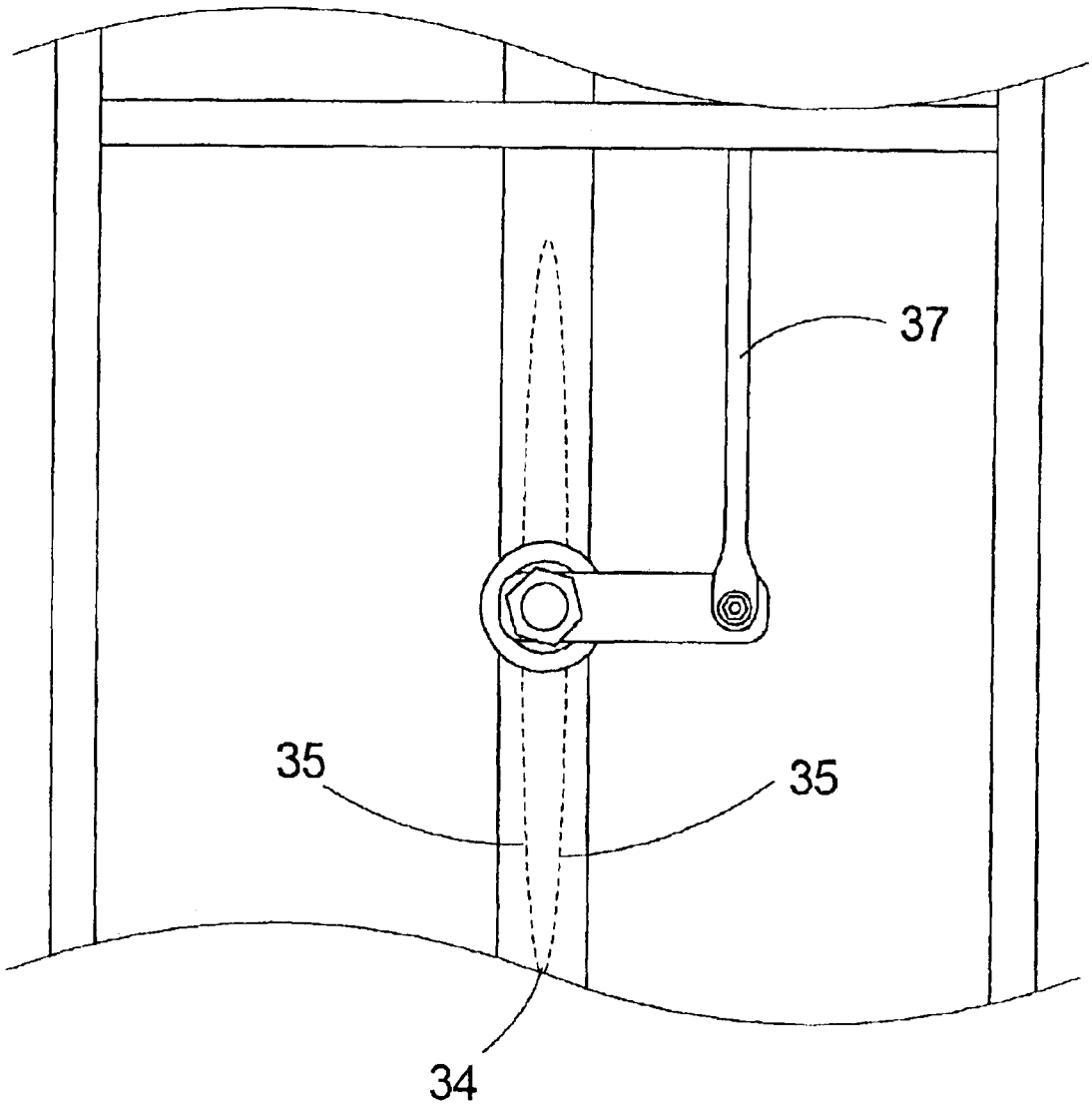
FIG. 9 is an enlarged top view of the connection between the linkage assembly and the rudder member of the direction assembly of the present invention.

With reference now to the drawings, and in particular to FIGS. 1 through 9 thereof, a new boat propulsion system embodying the principles and concepts of the present invention and generally designated by the reference numeral 10 will be described.

As best illustrated in FIGS. 1 through 9, the boat propulsion system 10 generally comprises a motor assembly 11 being designed for being positioned in a boat.

A propeller member 12 is operationally coupled to the motor assembly 11 whereby the propeller member 12 is rotated by the motor assembly 11. The propeller member 12 is designed for being positioned under the boat whereby the propeller member 12 is positioned in the water for rotating in the water to propel the boat through the water when the propeller member 12 is rotated by the motor assembly 11.

A direction assembly 13 is designed for being coupled to the boat. The direction assembly 13 is designed for being actuated by the user whereby the direction assembly 13 is for controlling the direction of the boat when the propeller member 12 is propelling the boat through the water.

A frame member 14 is coupled to the motor assembly 11. The frame member 14 is designed for being coupled to the boat whereby the frame member 14 mounts the motor assembly 11 to the boat. The frame member 14 is centered of the bottom of the boat to allow for the motor assembly 11 to be centered in the boat and allow for the weight of the motor assembly 11 to be spread throughout the boat.

A shroud member 15 is hingably coupled to the frame member 14. The shroud member 15 is selectively pivoted over the motor assembly 11 whereby the shroud member 15 is for inhibiting inadvertent access to the motor assembly 11 by a user when the shroud member 15 is positioned over the motor assembly 11.

The motor assembly 11 comprises a motor member 16 and a drive shaft 18. The drive shaft 18 is operationally coupled to the motor member 16 whereby the drive shaft 18 is rotated by the motor member 16 when the motor member 16 is running. The drive shaft 18 is coupled to the propeller member 12 whereby the propeller member 12 is rotated by the drive shaft 18 to propel the boat through the water when the drive shaft 18 is being rotated by the motor member 16. The motor member 16 may comprise an engine similar to those used in snow mobile which provides the advantage that the fuel and oil do not have to be mixed. The motor member 16 may also have a transmission that allows the drive shaft 18 to be rotated in one of two directions to allow the boat both forward and reverse movement through the water.

The motor assembly 11 comprises a torque converter assembly 19. The torque converter assembly 19 is operationally coupled between the motor member 16 and the drive shaft 18 whereby the torque converter assembly 19 is for adjusting the ratio of torque to speed between the motor member 16 and the drive shaft 18 when the drive shaft 18 is being rotated by the motor member 16.

The torque converter assembly 19 comprises a pulley member 20 and a variable diameter pulley 21. The pulley member 20 is coupled to the drive shaft 18. The variable diameter pulley 21 is operationally coupled to the motor member 16 whereby the variable diameter pulley 21 is rotated by the motor member 16 when the motor member 16 is running. A belt member 22 extends between the pulley member 20 and the variable diameter pulley 21 whereby the belt member 22 transfers rotation of the variable diameter pulley 21 to the pulley member 20 for rotating the drive shaft 18 when the variable diameter pulley 21 is rotated by the motor member 16. The variable diameter pulley 21 changes diameter to adjust the ratio of torque to speed as needed.

The motor assembly 11 comprises a slip clutch assembly 23. The slip clutch assembly 23 is operationally coupled between the torque converter assembly 19 and the drive shaft 1 8. The slip clutch assembly 23 is for disengaging the drive shaft 18 from the motor member 16 when the drive shaft 18 fails to rotate when the propeller member 12 strikes an obstruction in the water preventing rotation of the propeller member 12. In an alternate, the slip clutch assembly 23 may be directly coupled between the motor member The drive shaft 18 of the motor assembly 11 comprises a first shaft portion 24 and a second shaft portion 25. The first shaft portion 24 is operationally coupled to the motor member 16. The second shaft portion 25 is coupled to the propeller member 12. A knuckle member 26 is operationally coupled between the first shaft portion 24 and the second shaft portion 25 whereby the knuckle member 26 allows the second shaft portion 25 to be positioned at an angle to the first shaft portion 24 to extend through the boat to the propeller member 12. The knuckle is for transferring rotational movement of the first shaft portion 24 to the second shaft portion 25 to rotate the propeller member 12 when the first shaft portion 24 is rotated by the motor member 16.

A sleeve member 27 comprises a bore 28 extending through the sleeve member 27. The sleeve member 27 is designed for being coupled to the bottom of the boat whereby the sleeve member 27 is positioned at an angle to the bottom of the boat. The drive shaft 18 of the motor assembly 11 extends through the bore 28 of the sleeve member 27 whereby the propeller member 12 is positioned proximate a free end of the sleeve member 27. The sleeve member 27 is for protecting the drive shaft 18 from being damaged by impacting with debris in the water. The sleeve member 27 stabilizes the drive shaft 18 when the drive shaft 18 is being rotated by the motor member 16.

At least one bearing member 29 is positioned in the bore 28 of the sleeve member 27. The bearing member 29 is positioned between the sleeve member 27 and the drive shaft 18 whereby the bearing member 29 is for permitting free rotation of the drive shaft 18 with respect to the sleeve portion when the drive shaft 18 is being rotated by the motor member 16.

At least one support member 30 is coupled to the sleeve member 27 whereby the support member 30 is designed for extending between the sleeve member 27 and the boat. The support member 30 is for supporting the sleeve member 27 and inhibiting bending of the sleeve member 27 when the sleeve member 27 impacts with objects in the water.

At least one deflector member 31 is coupled to the sleeve member 27. The deflector member 31 extends outwardly from the sleeve member 27 whereby the deflector member 31 is designed for extending away from the boat. The deflector member 31 is designed for deflecting objects in the water away from the propeller member 12 to inhibit the objects from fowling the propeller member 12.

The deflector member 31 comprises a terminal edge 32. The terminal edge 32 of the deflector member 31 is positioned opposite the sleeve member 27. The terminal edge 32 of the deflector member 31 extends below the propeller member 12 whereby the terminal edge 32 of the deflector member 31 forces objects in the water below the propeller member 12 to inhibit the objects from fowling the propeller member 12.

The deflector member 31 comprises a plate. The plate is aligned with a longitudinal axis of the sleeve member 27. The plate is designed for extending along a portion of the length of the boat whereby the plate creates minimal drag through the water when the boat is being propelled through the water. The plate is designed for slicing into mud under the water and forcing the mud away from the propeller member 12.

The propeller member 12 comprises a pair of blades 33. One of the blades 33 is positioned diametrically from the other one of the blades 33 whereby the blades 33 are designed for rotating in the water in a screw type movement to propel the boat through the water when the propeller member 12 is being rotated.

The direction assembly 13 comprises a rudder member 34. The rudder member 34 comprises a pair of deflecting faces 35. The rudder member 34 is designed for being pivotally coupled to the boat whereby the rudder member 34 is positioned behind the propeller member 12. The rubber member is designed for being rotated by the user whereby the rudder member 34 is deflecting water passing under the boat off of one of the deflecting faces 35 to turn the boat a desired direction.

The direction assembly 13 comprises a control arm 36. The control arm 36 is designed for being pivotally coupled to the boat whereby the control arm 36 is positioned proximate the user in the boat. The control arm 36 is operationally coupled to the rudder member 34 whereby the control rudder member 34 is pivoted with respect to the boat when the user pivots the control arm 36 with respect to the boat.

The direction assembly 13 comprises a linkage assembly 37. The linkage assembly 37 is operationally coupled between the control arm 36 and the rudder member 34. The linkage assembly 37 translating pivotal movement of the control to pivotal movement of the rudder member 34 when the control arm 36 is pivoted with respect to the boat by the user.

A throttle control assembly 38 is coupled to the control arm 36 of the direction assembly 13 whereby the throttle control assembly 38 is designed for being actuated by the user when the user is using the control arm 36 to control the direction of the boat. The throttle control assembly 38 is operationally coupled to the motor assembly 11 whereby the throttle control assembly 38 is for controlling the motor assembly 11 to control the rate at which the motor assembly 11 rotates the propeller member 12 when the throttle control assembly 38 is actuated by the user.

In use, the user positions the boat in the water and positioned themselves in the boat proximate the control arm 36 of the direction assembly 13. The user then starts the motor member 16 and uses the throttle assembly to control the speed of the boat. The control arm 36 is pivoted one direction to pivot the rudder member 34 one direction to steer the boat in a first direct with the control being pivoted in a second direction to pivot the rudder member 34 in a second direction to steer the boat in a second direction. The deflector member 31 allows the boat to be used in shallow areas by deflecting objects in the water away from the propeller member 12 and cutting into the mud so that propeller member 12 can continue to propel the boat through the water.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A boat propulsion system for propelling a boat over water, the boat propulsion system comprising:

a motor assembly being adapted for being positioned in the boat;

a propeller member being operationally coupled to said motor assembly such that said propeller member is rotated by the motor assembly, said propeller member being adapted for being positioned under the boat such that said propeller member is positioned in the water for rotating in the water to propel the boat through the water when said propeller member is rotated by said motor assembly;

a direction assembly being adapted for being coupled to the boat, said direction assembly being adapted for being actuated by the user such that said direction assembly is for controlling the direction of the boat when said propeller member is propelling the boat through the water;

said motor assembly comprising a motor member and a drive shaft, said drive shaft being operationally coupled to said motor member such that said drive shaft is rotated by said motor member when said motor member is running, said drive shaft being coupled to said propeller member such that said propeller member is rotated by said drive shaft to propel the boat through the water when said drive shaft is being rotated by said motor member;

said motor assembly comprising a torgue converter assembly, said torque converter assembly being operationally coupled between said motor member and said drive shaft such that said torque converter assembly is for adjusting the ratio of torque to speed between said motor member and said drive shaft when said drive shaft is being rotated by said motor member; and said motor assembly comprising a slip clutch assembly, said slip clutch assembly being operationally coupled between said torque converter assembly and said drive shaft, said slip clutch assembly being for disengaging said drive shaft from said motor member when said drive shaft fails to rotate when said propeller member strikes an obstruction in the water preventing rotation of said propeller member.

2. The boat propulsion system as set forth in claim 1, further comprising:

a frame member being coupled to said motor assembly, said frame member being adapted for being coupled to the boat such that said frame member mounts said motor assembly to the boat.

3. The boat propulsion system as set forth in claim 2, further comprising:

a shroud member being hingably coupled to said frame member, said shroud member being selectively pivoted over said motor assembly such that said shroud member is for inhibiting inadvertent access to said motor assembly by a user when said shroud member is positioned over said motor assembly.

4. The boat propulsion system as set forth in claim 1, further comprising:

said torque converter assembly comprising a pulley member and a variable diameter pulley, said pulley member being coupled to said drive shaft, said variable diameter pulley being operationally coupled to said motor member such that said variable diameter pulley is rotated by said motor member when said motor member is running, a belt member extending between said pulley member and said variable diameter pulley such that said belt member transfers rotation of said variable diameter pulley to said pulley member for rotating said drive shaft when said variable diameter pulley is rotated by said motor member.

5. The boat propulsion system as set forth in claim 1, further comprising:

said drive shaft of said motor assembly comprising a first shaft portion and a second shaft portion, said first shaft portion being operationally coupled to said motor member, said second shaft portion being coupled to said propeller member, a knuckle member being operationally coupled between said first shaft portion and said second shaft portion such that said knuckle member allows said second shaft portion to be positioned at an angle to said first shaft portion to extend through the boat to said propeller member, said knuckle being for transferring rotational movement of said first shaft portion to said second shaft portion to rotate said propeller member when said first shaft portion is rotated by said motor member.

6. The boat propulsion system as set forth in claim 1, further comprising:

a sleeve member comprising a bore extending through said sleeve member, said sleeve member being adapted for being coupled to a bottom of the boat such that said sleeve member is positioned at an angle to the bottom of the boat, said drive shaft of said motor assembly extending through said bore of said sleeve member such that said propeller member is positioned proximate a free end of said sleeve member, said sleeve member being for protecting said drive shaft from being damaged by impacting with debris in the water, said sleeve member stabilizing said drive shaft when said drive shaft is being rotated by said motor member.

7. The boat propulsion system as set forth in claim 6, further comprising:

at least one bearing member being positioned in said bore of said sleeve member, said bearing member being positioned between said sleeve member and said drive shaft such that said bearing member is for permitting free rotation of said drive shaft with respect to said sleeve portion when said drive shaft is being rotated by said motor member.

8. The boat propulsion system as set forth in claim 6, further comprising:

at least one support member being coupled to said sleeve member such that said support member is adapted for extending between said sleeve member and the boat, said support member being for supporting said sleeve member and inhibiting bending of said sleeve member when said sleeve member impacts with objects in the water.

9. The boat propulsion system as set forth in claim 6, further comprising:

at least one deflector member being coupled to said sleeve member, said deflector member extending outwardly from said sleeve member such that said deflector member is adapted for extending away from the boat, said deflector member being adapted for deflecting objects in the water away from said propeller member to inhibit the objects from fowling said propeller member.

10. The boat propulsion system as set forth in claim 9, further comprising:

said deflector member comprising a terminal edge, said terminal edge of said deflector member being positioned opposite said sleeve member, said terminal edge of said deflector member extending below said propeller member such that said terminal edge of said deflector member forces objects in the water below said propeller member to inhibit the objects from fowling said propeller member.

11. The boat propulsion system as set forth in claim 9, further comprising:

said deflector member comprising a plate, said plate being aligned with a longitudinal axis of said sleeve member, said plate being adapted for extending along a portion of the length of the boat such that said plate creates minimal drag through the water when the boat is being propelled through the water, said plate being adapted for slicing into mud under the water and forcing the mud away from the propeller member.

12. The boat propulsion system as set forth in claim 1, further comprising:

said propeller member comprising a pair of blades, one of said blades being positioned diametrically from the other one of said blades such that said blades are adapted for rotating in the water in a screw type movement to propel the boat through the water when said propeller member is being rotated.

13. The boat propulsion system as set forth in claim 1, further comprising:

said direction assembly comprising a rudder member, said rudder member comprising a pair of deflecting faces, said rudder member being adapted for being pivotally coupled to the boat such that said rudder member is positioned behind said propeller member, said rubber member being adapted for being rotated by the user such that said rudder member is deflecting water passing under the boat off of one of said deflecting faces to turn the boat a desired direction.

14. The boat propulsion system as set forth in claim 13, further comprising:

said direction assembly comprising a control arm, said control arm adapted for being pivotally coupled to the boat such that said control arm is positioned proximate the user in the boat, said control arm being operationally coupled to said rudder member such that said control rudder member is pivoted with respect to the boat when the user pivots said control arm with respect to the boat.

15. The boat propulsion system as set forth in claim 14, further comprising:

said direction assembly comprising a linkage assembly, said linkage assembly being operationally coupled between said control arm and said rudder member, said linkage assembly translating pivotal movement of said control to pivotal movement of said rudder member when said control arm is pivoted with respect to the boat by the user.

16. The boat propulsion system as set forth in claim 14, further comprising:

a throttle control assembly being coupled to said control arm of said direction assembly such that said throttle control assembly is adapted for being actuated by the user when the user is using said control arm to control the direction of the boat, said throttle control assembly being operationally coupled to said motor assembly such that said throttle control assembly is for controlling the motor assembly to control the rate at which said motor assembly rotates said propeller member when said throttle control assembly is actuated by the user.

17. A boat propulsion system for propelling a boat over water, the boat propulsion system comprising:

a motor assembly being adapted for being positioned in the boat;

a propeller member being operationally coupled to said motor assembly such that said propeller member is rotated by the motor assembly, said propeller member being adapted for being positioned under the boat such that said propeller member is positioned in the water for rotating in the water to propel the boat through the water when said propeller member is rotated by said motor assembly;

a direction assembly being adapted for being coupled to the boat, said direction assembly being adapted for being actuated by the user such that said direction assembly is for controlling the direction of the boat when said propeller member is propelling the boat through the water;

a frame member being coupled to said motor assembly, said frame member being adapted for being coupled to the boat such that said frame member mounts said motor assembly to the boat;

a shroud member being hingably coupled to said frame member, said shroud member being selectively pivoted over said motor assembly such that said shroud member is for inhibiting inadvertent access to said motor assembly by a user when said shroud member is positioned over said motor assembly;

said motor assembly comprising a motor member and a drive shaft, said drive shaft being operationally coupled to said motor member such that said drive shaft is rotated by said motor member when said motor member is running, said drive shaft being coupled to said propeller member such that said propeller member is rotated by said drive shaft to propel the boat through the water what said drive shaft is being rotated by said motor member;

said motor assembly comprising a torque converter assembly, said torque converter assembly being operationally coupled between said motor member and said drive shaft such that said torque converter assembly is for adjusting the ratio of torque to speed between said motor member and said drive shaft when said drive shaft is being rotated by said motor member;

said torque converter assembly comprising a pulley member and a variable diameter pulley, said pulley member being coupled to said drive shaft, said variable diameter pulley being operationally coupled to said motor member such that said variable diameter pulley is rotated by said motor member when said motor member is running, a belt member extending between said pulley member and said variable diameter pulley such that said belt member transfers rotation of said variable diameter pulley to said pulley member for rotating said drive shaft when said variable diameter pulley is rotated by said motor member;

said motor assembly comprising a slip clutch assembly, said slip clutch assembly being operationally coupled between said torque converter assembly and said drive shaft, said slip clutch assembly being for disengaging said drive shaft from said motor member when said drive shaft fails to rotate when said propeller member strikes an obstruction in the water preventing rotation of said propeller member;

said drive shaft of said motor assembly comprising a first shaft portion and a second shaft portion, said first shaft portion being operationally coupled to said motor member, said second shaft portion being coupled to said propeller member, a knuckle member being operationally coupled between said first shaft portion and said second shaft portion such that said knuckle member allows said second shaft portion to be positioned at an angle to said first shaft portion to extend through the boat to said propeller member, said knuckle being for transferring rotational movement of said first shaft portion to said second shaft portion to rotate said propeller member when said first shaft portion is rotated by said motor member;

a sleeve member comprising a bore extending through said sleeve member, said sleeve member being adapted for being coupled to a bottom of the boat such that said sleeve member is positioned at an angle to the bottom of the boat, said drive shaft of said motor assembly extending through said bore of said sleeve member such that said propeller member is positioned proximate a free end of said sleeve member, said sleeve member being for protecting said drive shaft from being damaged by impacting with debris in the water, said sleeve member stabilizing said drive shaft when said drive shaft is being rotated by said motor member;

at least one bearing member being positioned in said bore of said sleeve member, said bearing member being positioned between said sleeve member and said drive shaft such that said bearing member is for permitting free rotation of said drive shaft with respect to said sleeve portion when said drive shaft is being rotated by said motor member;

at least one support member being coupled to said sleeve member such that said support member is adapted for extending between said sleeve member and the boat, said support member being for supporting said sleeve member and inhibiting bending of said sleeve member when said sleeve member impacts with objects in the water;

at least one deflector member being coupled to said sleeve member, said deflector member extending outwardly from said sleeve member such that said deflector member is adapted for extending away from the boat, said deflector member being adapted for deflecting objects in the water away from said propeller member to inhibit the objects from fowling said propeller member;

said deflector member comprising a terminal edge, said terminal edge of said deflector member being positioned opposite said sleeve member, said terminal edge of said deflector member extending below said propeller member such that said terminal edge of said deflector member forces objects in the water below said propeller member to inhibit the objects from fowling said propeller member;

said deflector member comprising a plate, said plate being aligned with a longitudinal axis of said sleeve member, said plate being adapted for extending along a portion of the length of the boat such that said plate creates minimal drag through the water when the boat is being propelled through the water, said plate being adapted for slicing into mud under the water and forcing the mud away from the propeller member;

said propeller member comprising a pair of blades, one of said blades being positioned diametrically from the other one of said blades such that said blades are adapted for rotating in the water in a screw type movement to propel the boat through the water when said propeller member is being rotated;

said direction assembly comprising a rudder member, said rudder member comprising a pair of deflecting faces, said rudder member being adapted for being pivotally coupled to the boat such that said rudder member is positioned behind said propeller member, said rubber member being adapted for being rotated by the user such that said rudder member is deflecting water passing under the boat off of one of said deflecting faces to turn the boat a desired direction;

said direction assembly comprising a control arm, said control arm adapted for being pivotally coupled to the boat such that said control arm is positioned proximate the user in the boat, said control arm being operationally coupled to said rudder member such that said control rudder member is pivoted with respect to the boat when the user pivots said control arm with respect to the boat;

said direction assembly comprising a linkage assembly, said linkage assembly being operationally coupled between said control arm and said rudder member, said linkage assembly translating pivotal movement of said control to pivotal movement of said rudder member when said control arm is pivoted with respect to the boat by the user; and a throttle control assembly being coupled to said control arm of said direction assembly such that said throttle control assembly is adapted for being actuated by the user when the user is.using said control arm to control the direction of the boat, said throttle control assembly being operationally coupled to said motor assembly such that said throttle control assembly is for controlling the motor assembly to control the rate at which said motor assembly rotates said propeller member when said throttle control assembly is actuated by the user.

* * * * *